US012201181B2

(12) United States Patent
Sakaguchi et al.

(10) Patent No.: US 12,201,181 B2
(45) Date of Patent: Jan. 21, 2025

(54) SHOE SOLE AND SHOE

(71) Applicant: ASICS CORPORATION, Kobe (JP)

(72) Inventors: Masanori Sakaguchi, Hyogo (JP); Hiroaki Nishimura, Hyogo (JP); Tomoki Ishizashi, Hyogo (JP); Kenji Hirata, Hyogo (JP); Seiji Yano, Hyogo (JP); Seigo Nakaya, Hyogo (JP)

(73) Assignee: ASICS CORPORATION, Kobe (JP)

( * ) Notice: Subject to any disclaimer, the term of this patent is extended or adjusted under 35 U.S.C. 154(b) by 90 days.

(21) Appl. No.: 18/002,637

(22) PCT Filed: Jun. 26, 2020

(86) PCT No.: PCT/JP2020/025211
§ 371 (c)(1),
(2) Date: Dec. 20, 2022

(87) PCT Pub. No.: WO2021/260920
PCT Pub. Date: Dec. 30, 2021

(65) Prior Publication Data

US 2023/0240408 A1 Aug. 3, 2023

(51) Int. Cl.
*A43B 13/12* (2006.01)
*A43B 13/14* (2006.01)
*A43B 13/18* (2006.01)

(52) U.S. Cl.
CPC ..... *A43B 13/18* (2013.01); *A43B 13/12* (2013.01); *A43B 13/14* (2013.01)

(58) Field of Classification Search
CPC ..... A43B 13/12; A43B 13/14; A43B 13/143; A43B 13/148

(Continued)

(56) References Cited

U.S. PATENT DOCUMENTS 4,302,892 A * 12/1981 Adamik ..... A43B 13/14 36/31
4,481,726 A * 11/1984 Phillips ..... A43B 13/12 36/30 R (Continued)

FOREIGN PATENT DOCUMENTS

FR 2 898 252 A1 9/2007
JP S49-025651 U 3/1974

(Continued)

OTHER PUBLICATIONS

An Office Action; "Decision of Refusal," mailed by the Japanese Patent Office on Apr. 30, 2024, which corresponds to Japanese Patent Application No. 2022-532207 and is related to U.S. Appl. No. 18/002,637; with English language translation.

(Continued)

*Primary Examiner* — Marie D Bays
(74) *Attorney, Agent, or Firm* — Studebaker & Brackett PC

(57) ABSTRACT

A shoe sole 1 includes a bottom part 20 and a deformation restraining part 30. The bottom part 20 includes: a rear bottom surface part 24 formed to extend from a rearfoot to a midfoot portion and to be, when the shoe sole is placed on a virtual surface S as a flat surface, in contact with the virtual surface S; and a toe portion 26 of which a height from the virtual surface S is set to 100% or greater and 250% or less with respect to a thickness in the rear bottom surface part 24. The deformation restraining part 30 is disposed in an edge part on a medial side and a lateral side of the bottom part 20 and extends from a forefoot to the midfoot portion along the bottom part 20. The deformation restraining part 30 has higher hardness than the bottom part 20.

17 Claims, 13 Drawing Sheets

(58) Field of Classification Search
USPC ..... 36/25 R
See application file for complete search history.

(56) References Cited

U.S. PATENT DOCUMENTS

| | | | | | |
|---|---|---|---|---|---|
| 4,654,983 | A * | 4/1987 | Graham | A43B 13/12 | 36/114 |
| 4,730,402 | A * | 3/1988 | Norton | A43B 13/12 | 36/114 |
| 4,731,939 | A * | 3/1988 | Parracho | A43B 7/144 | 36/31 |
| 4,759,136 | A * | 7/1988 | Stewart | A43B 13/187 | 36/31 |
| 5,396,675 | A * | 3/1995 | Vincent | B29D 35/122 | 36/114 |
| 5,572,805 | A * | 11/1996 | Giese | A43B 13/188 | 36/31 |
| 5,921,004 | A * | 7/1999 | Lyden | A43B 13/14 | 36/114 |
| 6,601,042 | B1 * | 7/2003 | Lyden | G06Q 30/0621 | 36/38 |
| 7,941,940 | B2 * | 5/2011 | Teteriatnikov | A43B 13/145 | 36/31 |
| 10,842,224 | B2 | 11/2020 | Farina et al. | | |
| 2012/0192451 | A1 * | 8/2012 | Fujikura | A43B 7/1455 | 36/44 |
| 2012/0324758 | A1 * | 12/2012 | Tang | A43B 7/144 | 36/28 |
| 2013/0118035 | A1 * | 5/2013 | Segato | A43B 13/16 | 36/102 |
| 2013/0318834 | A1 | 12/2013 | Mueller | | |
| 2016/0021972 | A1 * | 1/2016 | Grelle | A43B 7/1415 | 36/140 |
| 2016/0051009 | A1 | 2/2016 | Kormann et al. | | |
| 2017/0095033 | A1 | 4/2017 | Farina et al. | | |
| 2017/0347746 | A1 | 12/2017 | Van Bakel et al. | | |
| 2018/0084864 | A1 | 3/2018 | Takada et al. | | |
| 2018/0242685 | A1 * | 8/2018 | Jackinsky | A43B 7/144 | |
| 2018/0295936 | A1 * | 10/2018 | Hansen | B32B 5/32 | |
| 2021/0052036 | A1 | 2/2021 | Farina et al. | | |
| 2021/0227933 | A1 | 7/2021 | Farina et al. | | |
| 2022/0061458 | A1 * | 3/2022 | Hishikawa | A43B 5/06 | |
| 2022/0104581 | A1 * | 4/2022 | Sakaguchi | A43B 13/143 | |

FOREIGN PATENT DOCUMENTS

| | | | |
|---|---|---|---|
| JP | S59-103608 | U | 7/1984 |
| JP | 3041007 | U | 9/1997 |
| JP | 2000-316604 | A | 11/2000 |
| JP | 2007-143938 | A | 6/2007 |
| JP | 2016-043271 | A | 4/2016 |
| JP | 2018-529461 | A | 10/2018 |
| WO | 2019/118276 | A1 | 6/2019 |

OTHER PUBLICATIONS

The extended European search report issued by the European Patent Office on Jun. 14, 2023, which corresponds to European Patent Application No. 20942270.8-1015 and is related to U.S. Appl. No. 18/002,637.

International Search Report issued in PCT/JP2020/025211; mailed Sep. 8, 2020.

International Preliminary Report On Patentability (Chapter I) and Written Opinion of the International Searching Authority issued in PCT/JP2020/025211; issued Dec. 13, 2022.

* cited by examiner

SHOE SOLE AND SHOE

TECHNICAL FIELD

The present invention relates to shoe soles and shoes used for sports or the like.

BACKGROUND ART

Shoes used for sports or the like are desired to follow the motion of foot portions of the wearer and firmly support the feet during walking, running, or exercising, for example, and also to reduce fatigue of the feet.

For example, Patent Literature 1 discloses a shoe sole that includes a curved portion extending between an anterior-most point disposed in a forefoot region and a posterior-most point disposed closer to a heel region than the anterior-most point. The curved portion has a constant radius of curvature in a region from the anterior-most point to a metatarsophalangeal point (MP point).

PRIOR ART REFERENCE

Patent Literature

Patent Literature 1: Japanese Translation of PCT International Application Publication No. 2018-529461

SUMMARY OF INVENTION

Technical Problem

In Patent Literature 1, the shoe sole in the forefoot region is curved to reduce the length of the lever arm about the ankle, thereby reducing the strain at the ankle joint; however, dissipation of energy caused by the motion of the ankle joint itself is not considered. With regard to the dissipation of energy caused by the motion of the ankle joint itself, the inventors have obtained the following findings.

The range of motion of the ankle joint angle in the sagittal plane varies according to the relative height positions of the heel and the toe. For example, in a situation where a person walks or runs forward, when the heights of the heel and the toe are almost the same, the motion of the ankle joint accompanying the forward shift of the center of gravity becomes larger before rotational motion of the foot starts, so that the strain due to the dissipation of energy caused by the motion of the ankle joint itself is increased. In the shoe sole described in Patent Literature 1, the thickness of the shoe sole in the heel portion, i.e., the height of the heel portion, is almost the same as the height of the toe, as illustrated in FIG. 3 of Patent Literature 1 for example, and the ankle joint angle in the sagittal plane is not considered.

The present invention has been made in view of such an issue, and a purpose thereof is to provide a shoe sole and a shoe that can restrain the motion of the ankle joint and reduce the energy generated at the ankle joint.

Solution to Problem

An aspect of the present invention relates to a shoe sole. The shoe sole includes: a bottom part that includes a rear bottom surface part formed to extend from a rearfoot portion to a midfoot portion and to be, when the shoe sole is placed on a virtual surface as a flat surface, in contact with the virtual surface and that also includes a toe portion of which a height from the virtual surface is set to 100% or greater and 250% or less with respect to a thickness dimension in the rear bottom surface part; and a deformation restraining part (high stiffness part) that is disposed in an edge part on a medial side and a lateral side of the bottom part and extends from a forefoot portion to the midfoot portion along the bottom part and that has higher hardness than the bottom part.

A shoe sole of another aspect of the present invention includes: a bottom part that includes a rear bottom surface part formed to extend from a rearfoot portion to a midfoot portion and to be, when the shoe sole is placed on a virtual surface as a flat surface, in contact with the virtual surface and that also includes a front bottom surface part formed to continue to a front part of the rear bottom surface part and also curvedly extend to a toe portion such as to be spaced away from the virtual surface; and a deformation restraining part that is disposed in an edge part on a medial side and a lateral side of the bottom part and extends from a forefoot portion to the midfoot portion along the bottom part and that has higher rigidity than the bottom part. In the shoe sole, the rigidity against bending deformation in a vertical direction of the whole shoe sole is in the range from 20 N/mm to 50 N/mm inclusive.

A shoe sole of yet another aspect of the present invention includes: a bottom part including a bottom surface part that includes a rear bottom surface part formed to extend from a rearfoot portion to a midfoot portion and to be, when the shoe sole is placed on a virtual surface as a flat surface, in contact with the virtual surface and that also includes a front bottom surface part formed to continue to a front part of the rear bottom surface part and also curvedly extend to a toe portion such as to be spaced away from the virtual surface; and a deformation restraining part that is disposed in an edge part on a medial side and a lateral side of the bottom part and extends from a forefoot portion to the midfoot portion along the bottom part and that has higher hardness than the bottom part. In the shoe sole, the bottom part further includes an upper surface part that includes a first upper surface part constituted by a surface formed to extend from the rearfoot portion to the midfoot portion and formed to be parallel with the virtual surface or to extend downward from a rear part toward a front side in an unloading state and that also includes a second upper surface part constituted by a surface formed to continue to a front end of the first upper surface part and extend upward toward the front side to reach the toe portion. Also, in the shoe sole, a region facing an MP joint part of a foot is provided in the front bottom surface part in the bottom surface part and in the second upper surface part in the upper surface part.

A further aspect of the present invention relates to a shoe. The shoe includes a shoe sole described above, and an upper disposed on the shoe sole.

Optional combinations of the aforementioned constituting elements, and implementation of the present invention, including the constituting elements and expressions, in the form of methods or apparatuses may also be practiced as additional modes of the present invention.

Advantageous Effects of Invention

The present invention can restrain the motion of the ankle joint and reduce the energy generated at the ankle joint.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which.

DESCRIPTION OF EMBODIMENTS

Figure 1:
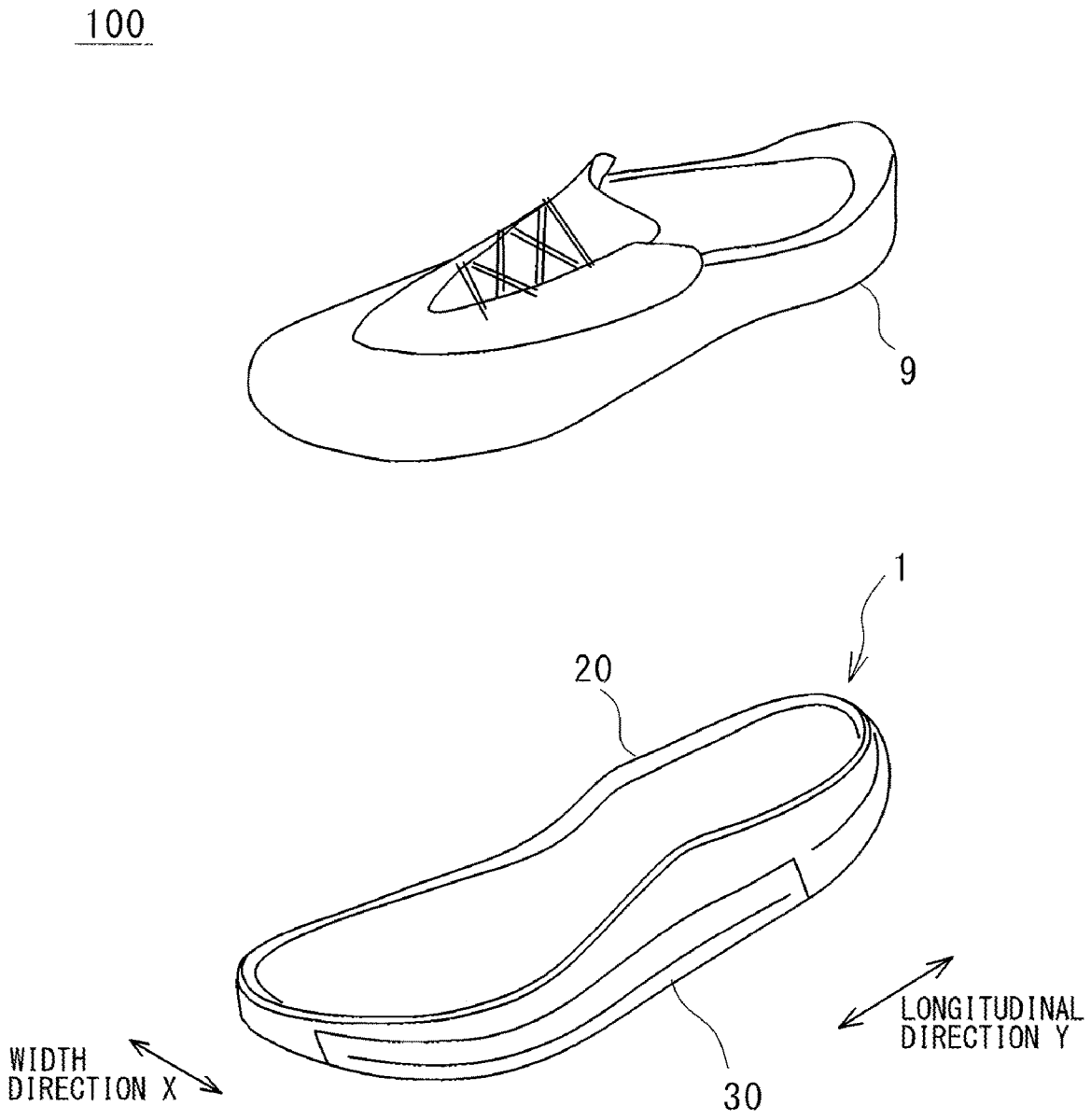
FIG. 1 is an exploded perspective view that illustrates an external view of a shoe according to a first embodiment.

In the following, the present invention will be described based on preferred embodiments with reference to FIGS. 1 through 13. Like reference characters denote like or corresponding constituting elements and members in each drawing, and repetitive description will be omitted as appropriate. Also, the dimensions of a member may be appropriately enlarged or reduced in each drawing in order to facilitate understanding. Further, in each drawing, part of members less relevant in describing embodiments may be omitted.

First Embodiment

FIG. 1 is an exploded perspective view that illustrates an external view of a shoe 100 according to the first embodiment. The shoe 100 includes an upper 9 and a shoe sole 1. The upper 9 is bonded to or sewed onto a circumferential edge part of the shoe sole 1 to cover the upper side of a foot. The shoe sole 1 includes an outer sole 10 (see FIG. 3), a bottom part 20, and a deformation restraining part 30, for example, and is configured by laminating the deformation restraining part 30 and the bottom part 20 on the outer sole 10 and further laminating an insole or the like thereon, which is not illustrated.

Figure 2:
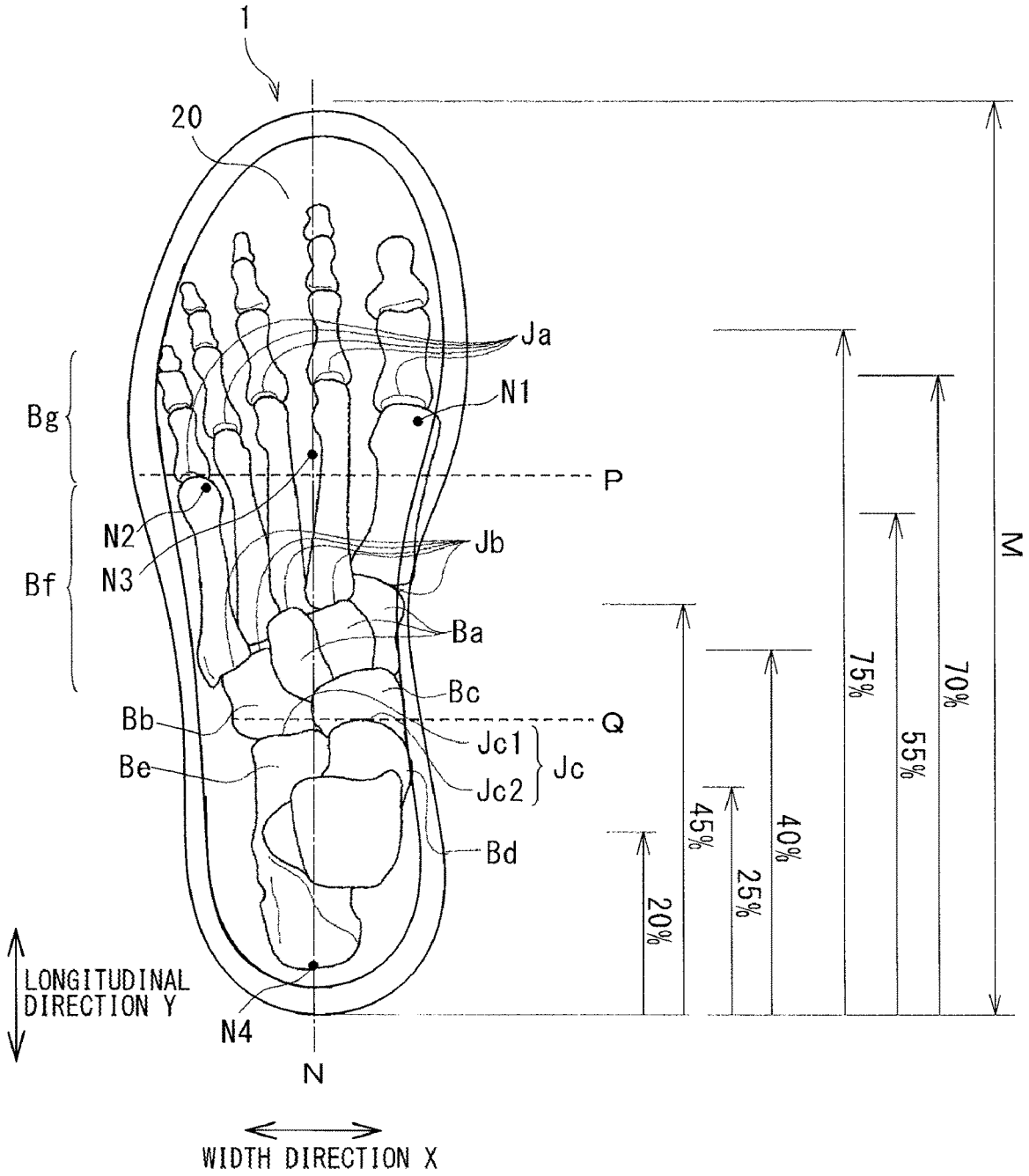
FIG. 2 is a schematic diagram in which a skeleton model of a human foot is superimposed upon a plan view of a shoe sole.

FIG. 2 is a schematic diagram in which a skeleton model of a human foot is superimposed upon a plan view of the shoe sole 1. A human foot is mainly constituted by cuneiform bones Ba, a cuboid bone Bb, a navicular bone Bc, a talus Bd, a calcaneus Be, metatarsal bones Bf, and phalanges Bg. Joints of a foot include MP joints Ja, Lisfranc joints Jb, and a Chopart's joint Jc. The Chopart's joint Jc includes a calcaneocuboid joint Jc1 formed by the cuboid bone Bb and the calcaneus Be, and a talocalcaneonavicular joint Jc2 formed by the navicular bone Bc and the talus Bd.

In the present invention, a center line N of a foot is represented by a straight line connecting a midpoint N3 between the center N1 of the thenar eminence and the center N2 of the hypothenar eminence, and the center N4 of the heel. For example, a longitudinal direction Y is in parallel with the center line N, and a width direction X is perpendicular to the center line N. A line P represents a straight line that extends along a width direction X, which is a direction perpendicular to the center line N, and that is assumed to pass through the heel-side end of the MP joints Ja. Also, a line Q represents a straight line that extends along a width direction X and that is assumed to pass through the toe-side end of the Chopart's joint Jc of the wearer. Hereinafter, a region from the line P to the toe is referred to as a forefoot portion, a region from the line P to the line Q is referred to as a midfoot portion, and a region from the line Q to the heel is referred to as a rearfoot portion. With regard to the relationship between the lines P, Q and the shoe 100, the line P is positioned within a range from 40% to 75% of the entire length M of the shoe 100 from the rear end on the heel side in a direction along the center line N, for example. More preferably, the line P is positioned within a range from 55% to 70% from the rear end. Also, the line Q is positioned within a range from 20% to 45% of the entire length M of the shoe 100 from the rear end on the heel side in a direction of a center line N. More preferably, the line Q is positioned within a range from 25% to 40% from the rear end.

Figure 3:
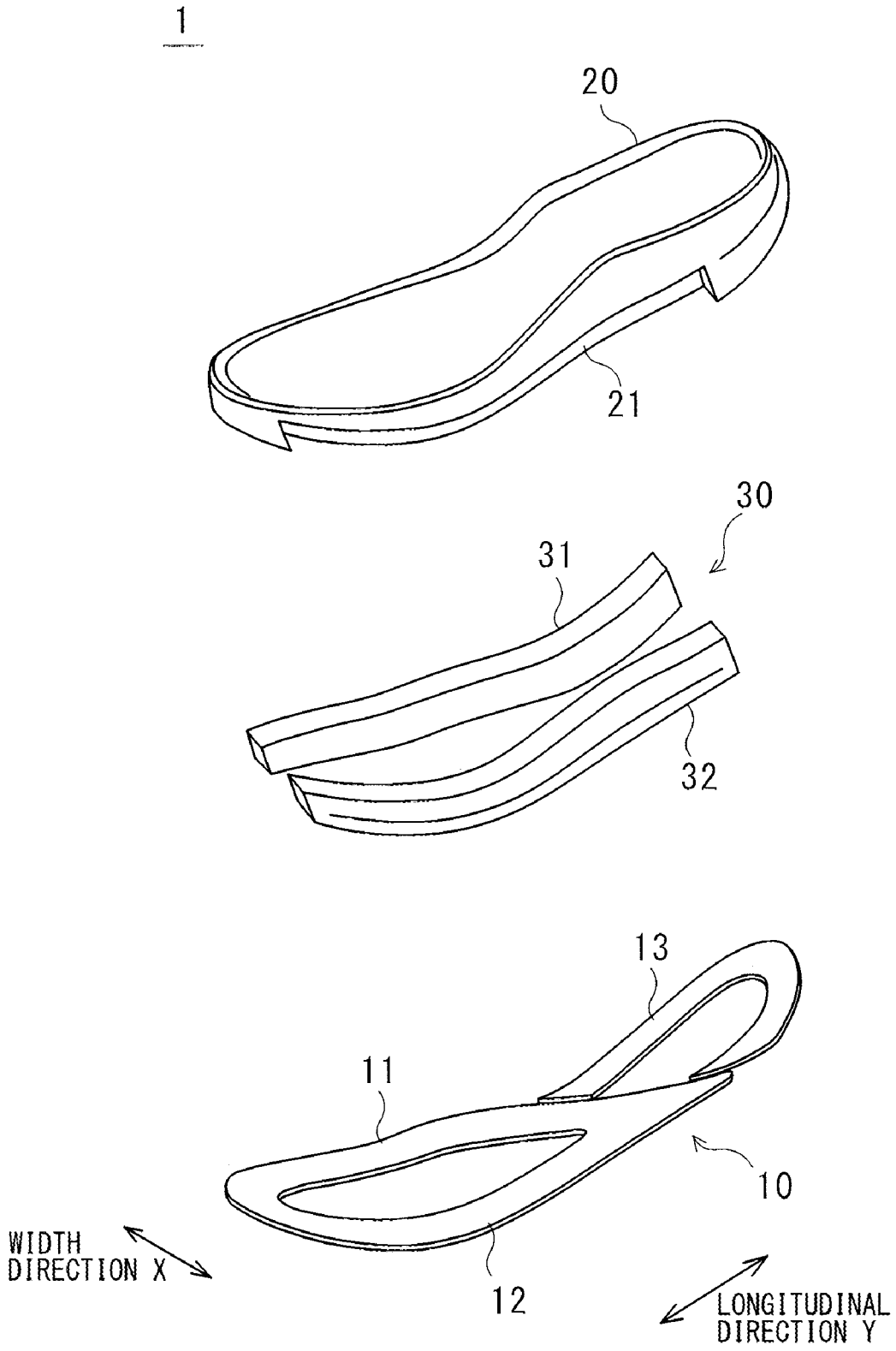
FIG. 3 is an exploded perspective view of the shoe sole.

FIG. 3 is an exploded perspective view of the shoe sole 1. The outer sole 10 includes a bottom surface portion, which comes into contact with a road surface, formed along the entire foot length in a longitudinal direction Y. The toe side is positioned higher than the heel side so that the motion of a foot from the landing to pushing off can be smoothly performed. The outer sole 10 is formed of a rubber material or the like, so as to absorb unevenness of the road surface and have abrasion resistance and durability.

The outer sole 10 includes a medial side cover portion 11 that extends from the toe to the midfoot portion on the medial side, a lateral side cover portion 12 that extends from the toe to the midfoot portion on the lateral side, and a heel cover portion 13. The medial side cover portion 11 and the lateral side cover portion 12 of the outer sole 10 are continuous at the toe and the midfoot portion and also extend from the midfoot portion to the rearfoot portion. The heel cover portion 13 is formed in a U-shape that extends from the rear end to the medial side and the lateral side. The heel cover portion 13 may be continuous with the medial side cover portion 11 and the lateral side cover portion 12 or may be separated from the medial side cover portion 11 and the lateral side cover portion 12 with a slight gap in between, as illustrated in FIG. 3.

The bottom part 20 is disposed on the outer sole 10 and formed along the entire foot length in a longitudinal direction Y. The toe side of the bottom part 20 is positioned higher than the heel side thereof so that the motion of a foot from the landing to pushing off can be smoothly performed. The bottom part 20 includes a recess 21 in an edge part on each of the medial side and the lateral side. The recesses 21 are formed such as to hole the lower surface side and both the left and right side surfaces of the bottom part 20 and extend from the forefoot portion to the rearfoot portion.

The deformation restraining part 30 is constituted by a medial deformation restraining part 31 and a lateral deformation restraining part 32, which are stick-shaped. The medial deformation restraining part 31 and the lateral deformation restraining part 32 extend respectively on the medial side and the lateral side of the bottom part 20 from the forefoot portion to the rearfoot portion and are fitted and bonded to the recesses 21 provided in the edge part of the bottom part 20. The deformation restraining part 30 is provided closer to the vertically lower side of the bottom part 20 and is provided between the outer sole 10 and the bottom part 20. The hardness of the deformation restraining part 30 is higher than that of the outer sole 10 and the bottom part 20. In addition, the rigidity against the bending deformation in a vertical direction of the deformation restraining part 30 is also higher than that of the outer sole 10 and the bottom part 20. The rigidity against the bending deformation of the whole shoe sole 1 may be in the range from 20 N/mm to 50 N/mm inclusive, for example. It is assumed here that the rigidity against the bending deformation of the whole shoe sole 1 represents rigidity exhibited when the toe end of the shoe sole 1 is pressed in a vertical direction while the heel end of the shoe sole 1 is fixed.

Figure 4B:
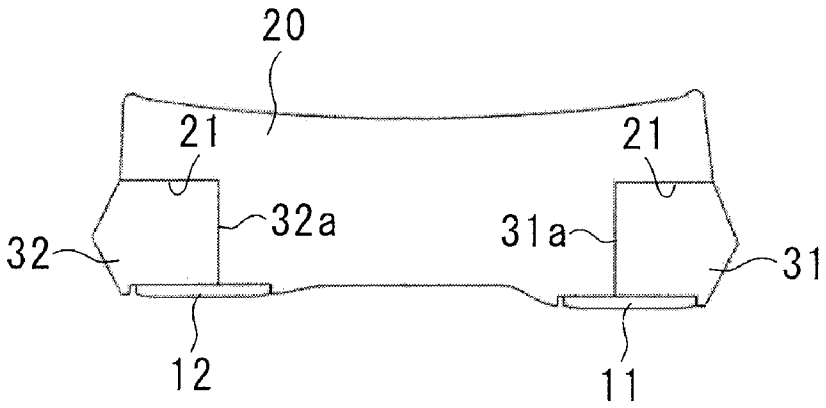
FIG. 4B is a sectional view taken along line A-A shown in FIG. 4A.
Figure 4A:
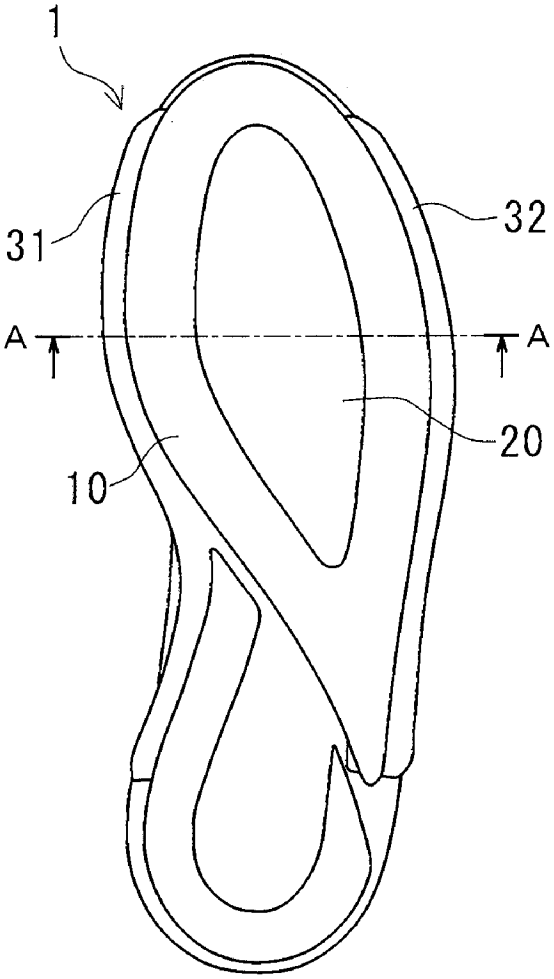
FIG. 4A is a bottom view of the shoe sole.

FIG. 4A is a bottom view of the shoe sole 1, and FIG. 4B is a sectional view taken along line A-A shown in FIG. 4A. The medial deformation restraining part 31 and the lateral deformation restraining part 32 each have a rectangular cross section and are bonded to the left and right side surfaces of the bottom part 20 at inner side surfaces 31*a* and 32*a*. The lower ends of the inner side surfaces 31*a* and 32*a* are covered with the medial side cover portion 11 and the lateral side cover portion 12 of the outer sole 10, thereby preventing peeling off of the medial deformation restraining part 31 and the lateral deformation restraining part 32 from the bottom part 20. The deformation restraining part 30 may be formed outside a region where the wearer's foot is in contact with the bottom part 20.

Figure 5A:
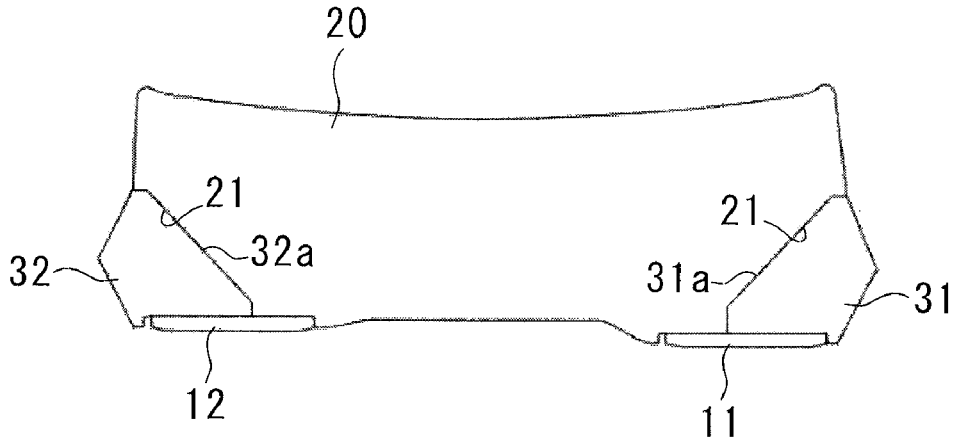
FIGS. 5A and 5B are sectional views of shoe soles according to modifications, taken along line A-A shown in FIG. 4A.
Figure 5B:
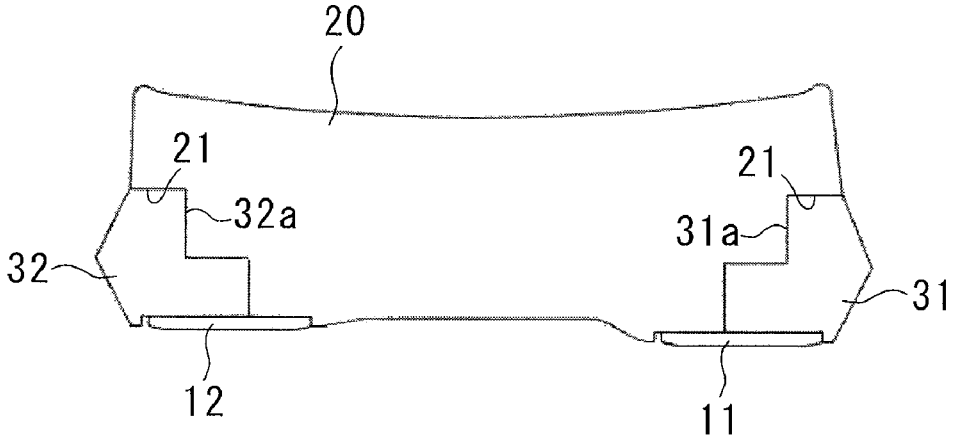

FIGS. 5A and 5B are sectional views of shoe soles 1 according to modifications, taken along line A-A shown in FIG. 4A. The medial deformation restraining part 31 and the lateral deformation restraining part 32 shown in FIG. 5A each have a triangular cross section, and the inner side surfaces 31*a* and 32*a* are inclined such as to extend inward in a lateral direction (width direction X) toward the lower side. The lower ends of the inner side surfaces 31*a* and 32*a* are covered with the medial side cover portion 11 and the lateral side cover portion 12 of the outer sole 10, thereby preventing peeling off of the medial deformation restraining part 31 and the lateral deformation restraining part 32 from the bottom part 20. Also, since the inner side surfaces 31*a* and 32*a* of the medial deformation restraining part 31 and the lateral deformation restraining part 32 are inclined such as to extend inward in a lateral direction toward the lower side, the feeling of hardness at a portion with which the foot comes into contact can be reduced.

The medial deformation restraining part 31 and the lateral deformation restraining part 32 shown in FIG. 5B are each formed to have an L-shaped cross section. The inner side surfaces 31*a* and 32*a* are each formed in a stair-like pattern with a stepped portion. The lower ends of the inner side surfaces 31*a* and 32*a* are covered with the medial side cover portion 11 and the lateral side cover portion 12 of the outer sole 10, thereby preventing peeling off of the medial deformation restraining part 31 and the lateral deformation restraining part 32 from the bottom part 20.

Figure 6A:
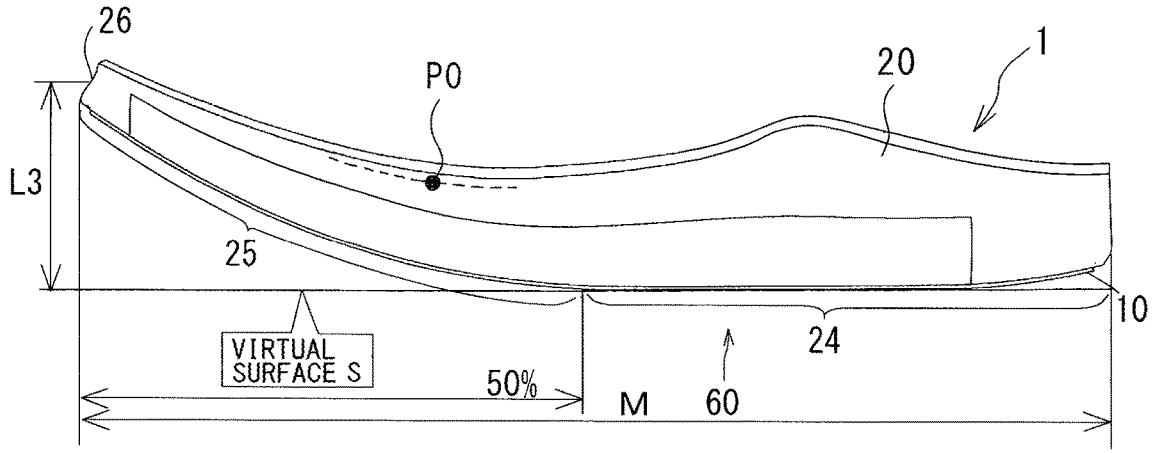
FIG. 6A is a side view of a lateral side of the shoe sole.
Figure 6B:
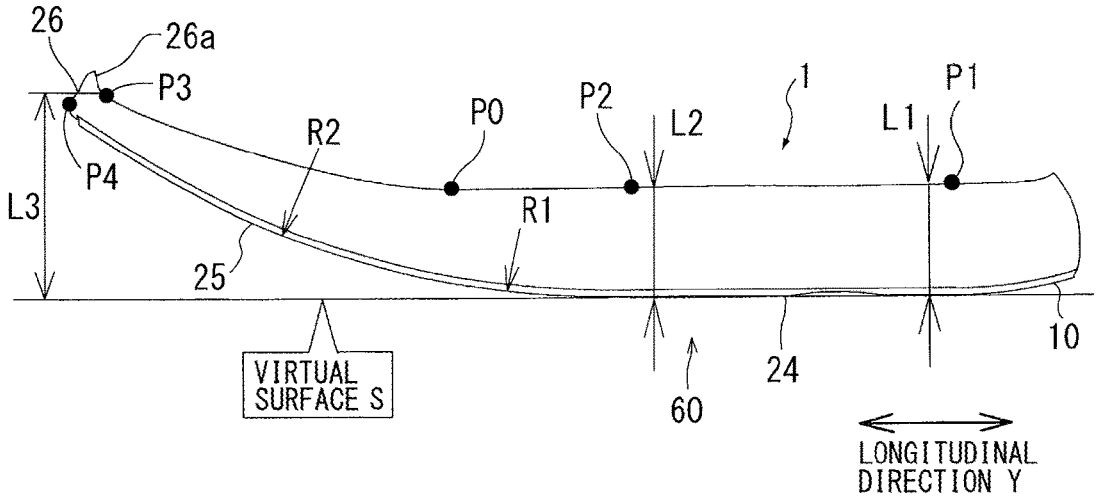
FIG. 6B is a vertical sectional view of the shoe sole, which includes a center line N shown in FIG. 2.

FIG. 6A is a side view of a lateral side of the shoe sole 1, and FIG. 6B is a vertical sectional view of the shoe sole, which includes the center line N shown in FIG. 2. When the shoe sole 1 is placed on a flat virtual surface S, such as a ground surface, a rear bottom surface part 24 extending from the midfoot portion to the rearfoot portion is in contact with the virtual surface S. The rear bottom surface part 24 may be in contact with the virtual surface S entirely in a longitudinal direction or may be partially spaced away from the virtual surface S, such as in a rear part of the heel portion. To improve the stability in a region from the heel portion to the midfoot portion at the time of landing, the portion to be in surface-contact of the rear bottom surface part 24 in the heel portion and the midfoot portion may preferably be provided in a range of 20% or greater of the entire length M of the shoe sole 1, and more preferably be provided in a range of 35% or greater thereof. With regard to the surface-contact, when fine asperities are provided on the rear bottom surface part 24, a surface that passes through the lowermost surfaces of the asperities may be regarded as a virtual rear bottom surface part 24.

A front bottom surface part 25 is provided to continue to the front part of the rear bottom surface part 24 and also extend to a toe portion 26 such as to be spaced away from the virtual surface S. The front bottom surface part 25 extends upward toward the front side and reaches the toe portion 26. The front bottom surface part 25 is formed only by a curved surface and a linear surface and does not include a portion extending downward toward the front side. The boundary between the rear bottom surface part 24 and the front bottom surface part 25 is positioned between the position of 50% of the entire length M of the shoe sole 1 from the front end and a point P0 corresponding to an MP joint (the entire length M is assumed to be identical with the entire length of the shoe 100, and the same applies hereinafter). The rear bottom surface part 24 and the front bottom surface part 25 form a bottom surface part 60. The point P0 corresponding to an MP joint may be a position corresponding to the thenar eminence on the upper surface of the bottom part 20, as shown in FIG. 6B, or may be a position corresponding to the hypothenar eminence among the MP joints. In other words, P0 may be positioned within a range from 55% to 75% of the entire length M of the shoe sole 1 from the rear end.

A height L3 of the toe portion 26 is defined as a height from the virtual surface to a point P3 at which an edge portion 26*a*, which is joined with the upper 9 in the upper surface of the bottom part 20 (an inner-side surface of the shoe 100), extends upward, as illustrated in FIG. 6B. The height L3 of the toe portion 26 may also be defined as a height from the virtual surface to a point P4, which is the tip of the outer shape of the toe portion 26. In the following description, the height from the virtual surface to the point P3 is used as the height L3 of the toe portion 26.

The thickness of the rear bottom surface part 24 side of the shoe sole 1 is considered based on one of a thickness L1 of the shoe sole 1 at a point P1 in the heel portion and a thickness L2 of the shoe sole 1 at a point P2 in the midfoot portion. The height L3 of the toe portion 26 is set to 100% or greater and 250% or less of the thickness L1 of the shoe sole 1 at the point P1 in the heel portion. The height L3 of the toe portion 26 may preferably be set to 170% or greater of the thickness L1 of the shoe sole 1 at the point P1 in the heel portion. The height L3 of the toe portion 26 is also set to 100% or greater and 250% or less of the thickness L2 of the shoe sole 1 at the point P2 in the midfoot portion. The height L3 of the toe portion 26 may preferably be set to 170% or greater of the thickness L2 of the shoe sole 1 at the point P2 in the midfoot portion. The position of the point P2 in the midfoot portion may be defined as a position in the thickest part within a range from about 30% to 40% of the entire length M of the shoe sole 1 from the rear end. When the height L3 of the toe portion 26 is defined as the height at the point P4, the height L3 is set to 80% or greater and 250% or less of the thickness L2 of the shoe sole 1 at the point P2 in the midfoot portion and may preferably be set to 150% or greater of the thickness L2 of the shoe sole 1 at the point P2 in the midfoot portion.

The position of the point P1 in the heel portion may be defined as a position in the thickest part in the heel portion (a range from 15% to 30% of the entire length M of the shoe sole 1 from the rear end), and the thickness dimension of the shoe sole 1 at the point P1 may be set to 20 mm or greater, for example. The rigidity against the bending deformation in an extension direction of the shoe sole 1 corresponding to an MP joint part, obtained by three-point bend testing, may be 20 N/mm or greater, for example. In the three-point bend testing, an 8-centimeter length in a longitudinal direction that crosses the MP joint part is supported at the both ends, a middle part between the both ends is pressed downward to obtain the relationship between the displacement and the load, and the slope of the displacement-load curve in a range of the displacement of 5 to 6 mm is obtained. Also, the difference between the thickness of the shoe sole 1 in the heel portion in an unloading state where a foot is not placed on the shoe sole 1 and the thickness of the shoe sole 1 at a position corresponding to the MP joint part may be set to 5 mm or less, for example.

Figure 7A:
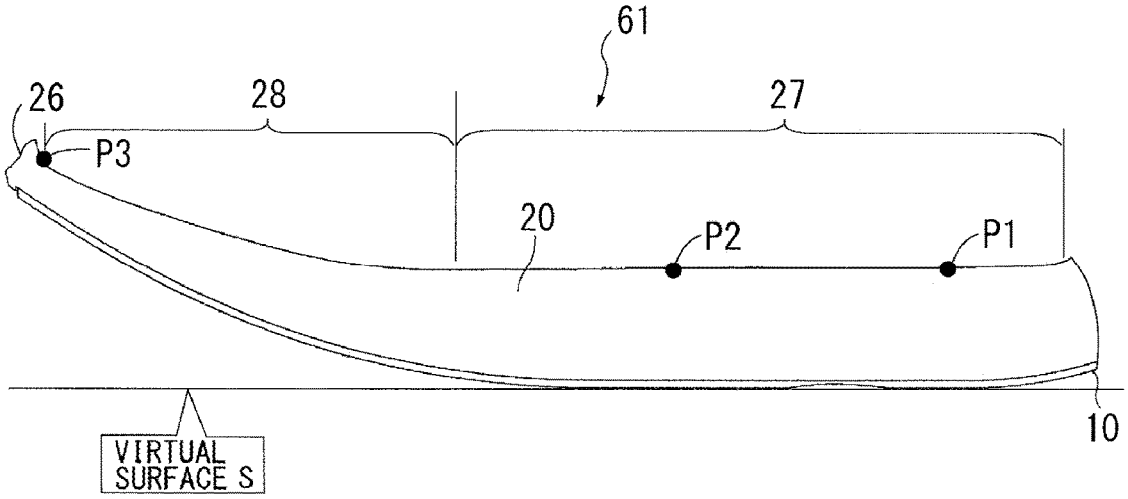
FIGS. 7A and 7B are schematic diagrams used to describe an upper surface part of the shoe sole.
Figure 7B:
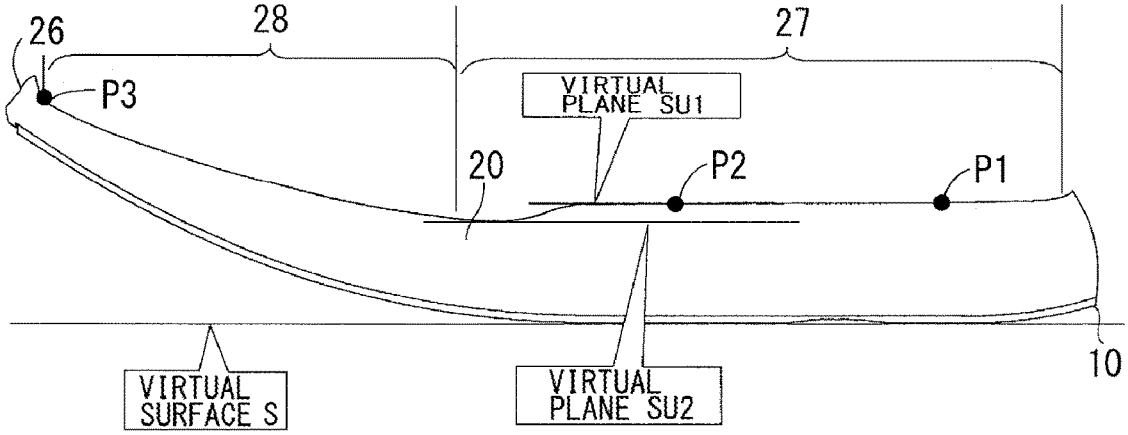
Figure 7B:
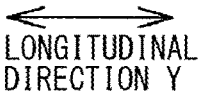

FIGS. 7A and 7B are schematic diagrams used to describe an upper surface part 61 of the shoe sole 1. Each of FIGS. 7A and 7B illustrates a sectional view similar to that in FIG. 6B. A first upper surface part 27 is formed to extend from the rearfoot portion to the midfoot portion and corresponds to a surface included in predetermined parallel conditions with respect to the virtual surface S in an unloading state. The surface included in predetermined parallel conditions means a surface positioned between a virtual plane SU1 and a virtual plane SU2. The virtual plane SU1 is the highest surface within a region that includes a front end of the first upper surface part 27 (front part), which will be described later, and a position of 15% of the entire length M of the shoe sole 1 from the rear end (rear part), and the virtual plane SU2 is the lowest surface in the region. The surface included in predetermined parallel conditions is also located within a region where the height difference between SU1 and SU2 is 12 mm or less and formed to be parallel with the virtual surface S or to incline downward from the rear part toward the front part. FIG. 7A illustrates the case where the first upper surface part 27 is parallel with the virtual surface S. FIG. 7B illustrates the first upper surface part 27 formed to incline downward from the rear part to the front part with a height reduction amount of 5 mm. For less incongruity on the bottom of a foot, the first upper surface part 27 may be suitably flat with fewer asperities; however, the first upper surface part 27 may have some asperities, have a height difference in a width direction, or have a twist, for example.

A second upper surface part 28 continues to the front end of the first upper surface part 27 and extends upward toward the front side to reach the toe portion 26. The second upper surface part 28 is formed only by a curved surface and a linear surface extending upward toward the front side and does not include a portion extending downward toward the front side. As illustrated in FIGS. 7A and 7B, the second upper surface part 28 is curved to be recessed with respect to the upper side. The boundary (front end) between the first upper surface part 27 and the second upper surface part 28 may be positioned within a range from 25% to 45% of the entire length M of the shoe sole 1 from the front end of the shoe sole 1, for example.

The upper surface of the bottom part 20 in the shoe sole 1 has been described with reference to FIGS. 7A and 7B. However, when an inner sole, omitted in the drawings, is provided on the bottom part 20, the first upper surface part 27 and the second upper surface part 28 as described above may be defined in the upper surface of the inner sole.

For the outer sole 10, rubber, rubber foam, thermoplastic polyurethane (TPU), a thermoplastic elastomer, and a thermosetting elastomer may be used, for example. The bottom part 20 may be formed of resin foam, for example. As a resin, a polyolefin resin, ethylene-vinyl acetate copolymer (EVA), or a styrene elastomer may be used, for example, and the resin may contain other arbitrary components, such as fiber, as appropriate. For the deformation restraining part 30, resin foam using a polyolefin resin, EVA, or a styrene elastomer may be used, for example, and the resin foam may contain other arbitrary components, such as cellulose nanofiber or other fiber, as appropriate.

The hardness of the outer sole 10 may be set to HA70, for example. Also, the hardness of the bottom part 20 may be set to HC55, and the hardness of the deformation restraining part 30 may be set to HC67, for example.

Figure 8:
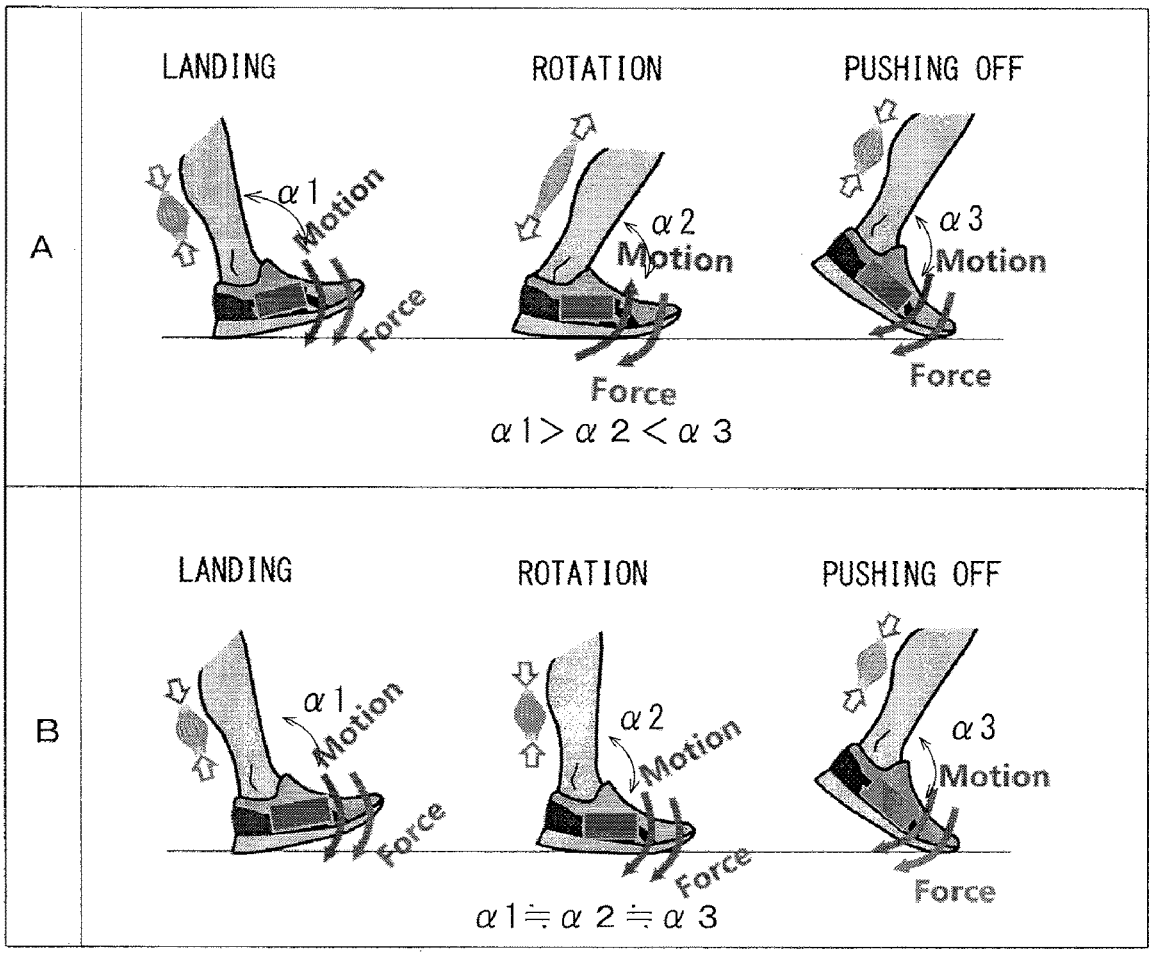
FIG. 8 is a chart used to describe rotational motion of the ankle joint in a longitudinal direction.

There will now be described the functions of the shoe 100. FIG. 8 is a chart used to describe rotational motion of the ankle joint in a longitudinal direction. A column A in FIG. 8 shows a case where the bottom surface of the shoe sole 1 is almost flat, and the rotational motion of the ankle joint in a longitudinal direction is large. In the column A, the body weight is shifted forward after the landing and the ankle joint is bent forward, so that an angle $\alpha(\alpha 2)$ at the ankle joint becomes smaller. Such rotational motion of the ankle joint causes stretch motion of muscles of the foot. Thereafter, the angle $\alpha(\alpha 3)$ at the ankle joint inversely becomes larger until the pushing off.

Meanwhile, a column B in FIG. 8 shows a case where the shoe sole 1 includes the front bottom surface part 25 described above, and the rotational motion of the ankle joint in a longitudinal direction is small. In the column B, when the body weight is shifted forward after the landing, the shoe sole 1 is rotated such that the front bottom surface part 25 comes into contact with a road surface. Accordingly, the forward rotational motion is restrained, so that the change of the angle $\alpha(\alpha 2)$ at the ankle joint is small. Thereafter, the change of the angle $\alpha(\alpha 3)$ at the ankle joint remains small until the pushing off.

Figure 9:
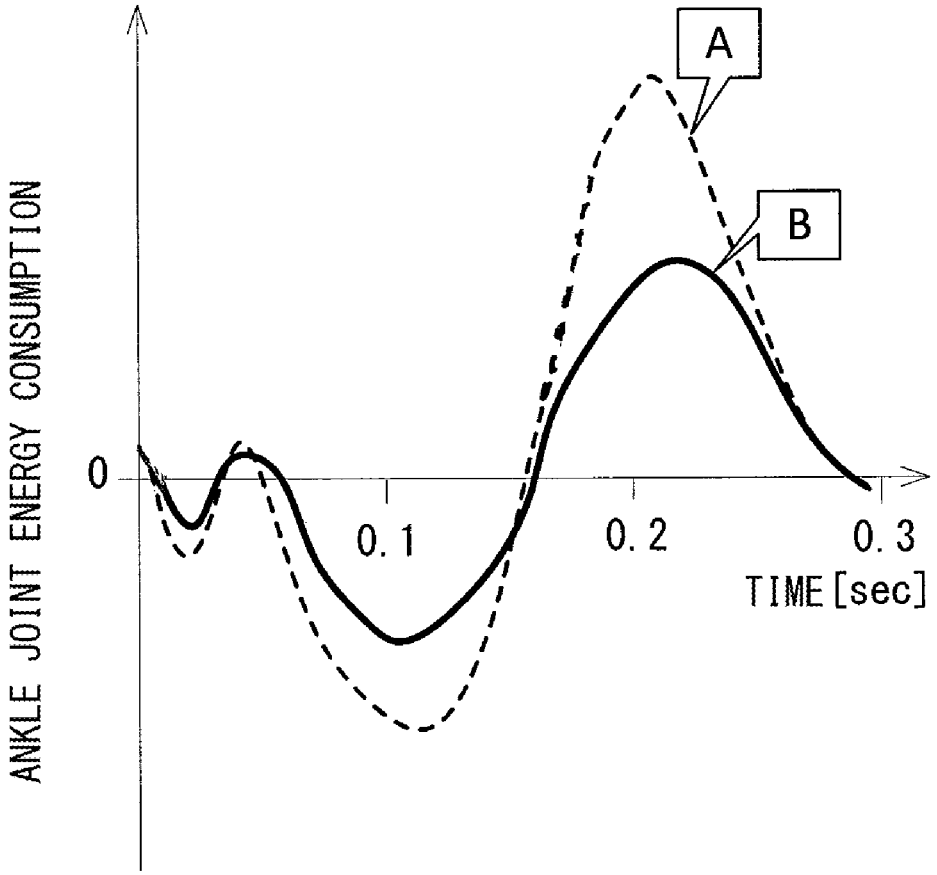
FIG. 9 is a graph as an example that shows energy consumption in the ankle joint.

FIG. 9 is a graph as an example that shows energy consumption in the ankle joint. In FIG. 9, the horizontal axis represents time, and the vertical axis represents energy consumption in the ankle joint, and the energy consumption is compared between the cases of the columns A and B in FIG. 8. Although energy consumption is generally a positive value, the case where muscles contract is indicated in the positive direction, and the case where muscles stretch is indicated in the negative direction, for the sake of convenience.

The energy consumption at the time of landing is greater in the case of the shoe sole 1 in the column A, compared to the case of the shoe sole 1 in the column B. The energy consumption at the time of landing is reduced mainly by the cushion member 22 provided in the heel portion of the shoe sole 1. Until the pushing off after the landing, the rotational motion of the ankle a at the ankle joint can be made smaller in the case of the column B compared to the case of the column A, as described with reference to FIG. 8. Accordingly, the energy consumption becomes smaller in the case of the column B.

With the rear bottom surface part 24 provided, the stability at the time of landing of a foot can be ensured in the shoe sole 1 of the shoe 100. Also, since the toe portion 26 is positioned higher than the rear bottom surface part 24, the rotational motion of the ankle joint in a longitudinal direction during walking and running is reduced and the energy consumption is also reduced, so that strain at the foot can be reduced. With reference to FIG. 6B, by setting the height L3 of the toe portion 26 from the virtual surface S to 100% or greater with respect to the thickness dimension L1 of the rear bottom surface part 24 in the heel portion, the effect of reducing the energy consumption can be achieved. Also, the height L3 of the toe portion 26 from the virtual surface S may preferably be set to 170% or greater of the thickness dimension L1 of the rear bottom surface part 24 in the heel portion. Also, by setting the height L3 of the toe portion 26 from the virtual surface S to 250% or less with respect to the thickness dimension L1 in the heel portion, the bending angle at the MP joint part of the foot can be maintained within a certain range.

By setting the height L3 of the toe portion 26 from the virtual surface S based on the thickness dimension L1 in the heel portion, after the landing of the heel portion, the strain at the ankle joint placed during the rotational motion of the shoe sole 1 toward the toe portion can be reduced. Also, the height L3 of the toe portion 26 from the virtual surface S may be set to 100% or greater and 250% or less with respect to the thickness dimension L2 in the midfoot portion. In this case, it is considered that, at least after the landing of the midfoot portion, the strain at the ankle joint placed during the rotational motion toward the toe portion 26 in the shoe sole 1 can be reduced. Also, the height L3 of the toe portion 26 from the virtual surface S may preferably be set to 100% or greater of the thickness dimension L2 in the midfoot portion.

With reference to FIGS. 7A and 7B, the first upper surface part 27 is formed as a surface included in predetermined parallel conditions, as described previously. The second upper surface part 28 is formed to continue to the front end of the first upper surface part 27 and extend upward toward the front side. By maintaining the downward inclination of the first upper surface part 27 toward the front side within a certain range, the upward inclination of the second upper surface part 28 toward the front side can be made gentle. Making the upward inclination of the second upper surface part 28 toward the front side gentle can restrain increase of the upward bending angle at the MP joint part of the foot.

Since the rear bottom surface part 24 includes a portion to be in surface-contact with the virtual surface S in the rearfoot portion and the midfoot portion, the stability at the time of landing of the rear bottom surface part 24 can be increased. Also, since the front bottom surface part 25 continues to the front part of the rear bottom surface part 24 and also curvedly extends to the toe portion 26, the rotational motion of the foot can be smoothly performed. In the front bottom surface part 25, by making a radius of curvature R1 in the rear part continuing to the rear bottom surface part smaller than a radius of curvature R2 in the toe portion, the rotational motion of the shoe sole 1 after the landing of the midfoot portion can be made to function more easily. The radius of curvature R1 smaller than the radius of curvature R2 may be positioned along the MP joint part from the medial side to the lateral side, for example. When R1 is set to 85% or less of R2, the effect of smoother rotational motion can be obtained.

Also, in the region of the front bottom surface part 25, the point P0 facing the MP joint part of a foot is included. Accordingly, while the rotational motion of the shoe sole 1 proceeds after the landing of the midfoot portion until the landing of the toe portion 26, the motion of the MP joint part of the foot is made smaller. With such smaller motion of the MP joint part of the foot, energy consumption in the MP joint part is reduced, and the strain caused by stretching and contraction in the MP joint part can be reduced.

The deformation restraining part 30 has higher hardness than the bottom part 20 and functions to restrain deformation of the shoe sole 1 or the foot, thereby maintaining a constant foot shape more easily. Since the deformation restraining part 30 is constituted by the medial deformation restraining part 31 and the lateral deformation restraining part 32, twisting deformation around a longitudinal axis of the shoe sole 1 can be allowed. For example, if the ground on which the foot has landed includes undulations on the medial side and the lateral side due to inclination or the like, the medial deformation restraining part 31 and the lateral deformation restraining part 32 can be independently deformed, so that the shoe sole 1 as a whole gets twisted and deformed around the longitudinal axis and hence can follow the undulations of the ground.

The bottom part 20 has lower hardness than the deformation restraining part 30 and functions as a deformation allowance part in the shoe sole 1 for absorbing impact at the time of landing or unevenness of the road surface. Also, the bottom part 20 is provided higher than the deformation restraining part 30 and is in contact with the wearer's foot. Accordingly, the lower hardness of the bottom part 20 can reduce the load on the foot due to impact or the like and the pushing up of the foot due to unevenness of the road surface. Also, when the deformation restraining part 30 is formed outside the region where the wearer's foot is in contact with the bottom part 20, the feeling of hardness on the medial side and the lateral side of the foot can be prevented.

The rigidity against the bending deformation of a material of a plate shape at the time of bending the material is generally determined based on the Young's modulus and the second moment of area of the material. If the material physical properties, including hardness, are the same and the width is also the same, the rigidity against the bending deformation is proportional to the cube of the material thickness. Accordingly, when the shoe sole 1 is made thinner, the material physical properties need to be supplemented by insertion of a high-strength member, such as a carbon fiber reinforced plastic, or increase of hardness of the outer sole 10, for example. The outer sole 10 also functions as a deformation restraining part.

When the toe portion 26 of the shoe sole 1 extends upward such that the height of the toe portion 26 is 150% or greater of the thickness dimension L1 of the shoe sole 1 in the heel portion or the thickness dimension L2 of the shoe sole 1 in the midfoot portion (at a position of 30% of the entire length M from the rear end, for example) and when the rigidity against the bending deformation in a longer axis direction in the forefoot portion of the shoe sole 1 (the rigidity at a position corresponding to the MP joint part) is three or more times larger than the rigidity of general running shoes (3 N/mm as a reference value), the deformation of the shoe sole 1 is restrained, and the effect of reducing the strain at the ankle joint can achieved.

When the height of the toe portion 26 extending upward is low, it is ineffective even though the shoe sole 1 is hard. Since the change of the angle at the ankle joint can be made small and the angular velocity can be reduced while the foot is in contact with the ground during walking and running, the workload of the ankle joint is reduced, thereby enabling walking and running with less effort.

Second Embodiment

Figure 10A:
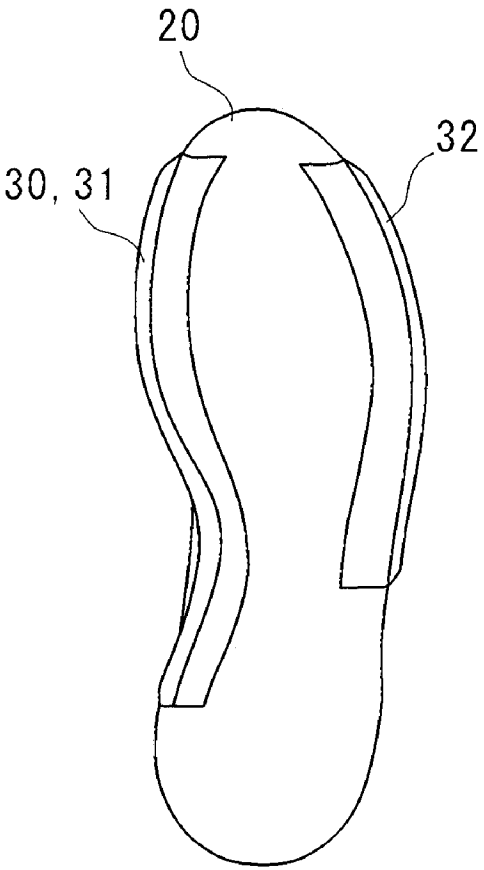
FIGS. 10A, 10B, and 10C are bottom views in which an outer sole of a shoe sole according to a second embodiment is omitted.
Figure 10B:
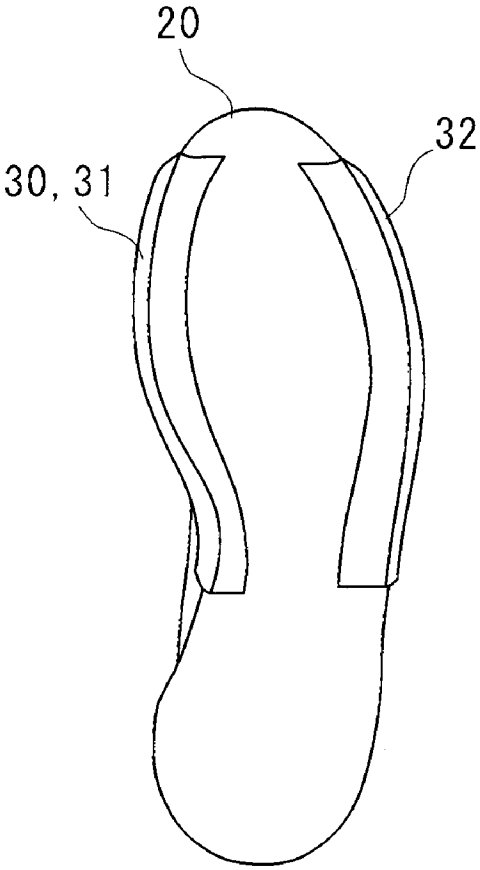
Figure 10C:
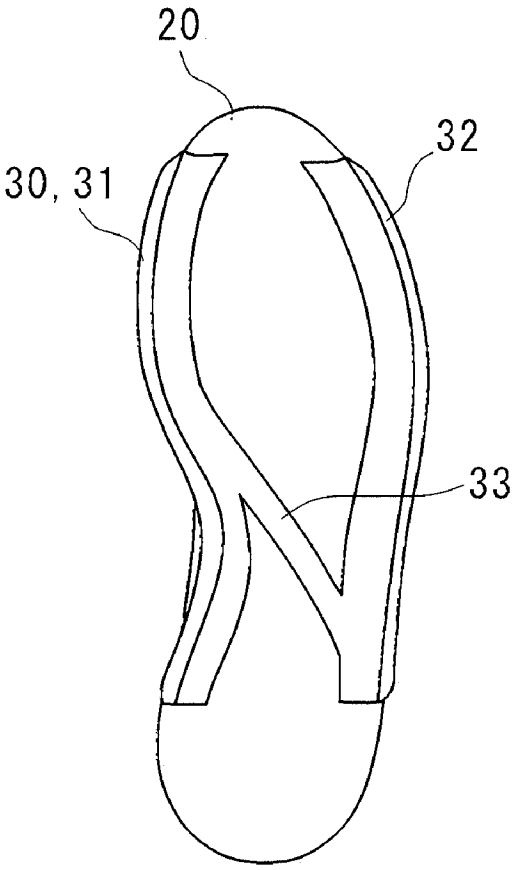

FIGS. 10A, 10B, and 10C are bottom views in which the outer sole of the shoe sole 1 according to the second embodiment is omitted. In the shoe sole 1 shown in FIG. 10A, the longitudinal length of the medial deformation restraining part 31 of the deformation restraining part 30 is longer than that of the lateral deformation restraining part 32. The medial deformation restraining part 31 extends from the forefoot portion to about the middle in a longitudinal direction of the rearfoot portion, and the lateral deformation restraining part 32 extends from the forefoot portion to the rear end of the midfoot portion or to the front end of the rearfoot portion. This can ease the restraint on the bending deformation in a vertical direction of the shoe sole 1 on the lateral side.

In the shoe sole 1 shown in FIG. 10B, the medial deformation restraining part 31 and the lateral deformation restraining part 32 of the deformation restraining part 30 have similar longitudinal lengths and each extend from the forefoot portion to the rear end of the midfoot portion or to the front end of the rearfoot portion. This can ease the restraint on the bending deformation in a vertical direction of the shoe sole 1 on the medial side and the lateral side.

In the shoe sole 1 shown in FIG. 10C, the medial deformation restraining part 31 and the lateral deformation restraining part 32 of the deformation restraining part 30 have similar longitudinal lengths and each extend from the forefoot portion to about the middle in a longitudinal direction of the rearfoot portion. Also, the deformation restraining part 30 includes a connection part 33 that connects a position around the middle in a longitudinal direction of the medial deformation restraining part 31 and a position around the rear end of the lateral deformation restraining part 32. With the connection part 33 provided, the positional relationship between the medial side and the lateral side of the deformation restraining part 30 can be maintained, so that the durability can be improved.

Third Embodiment

Figure 11:
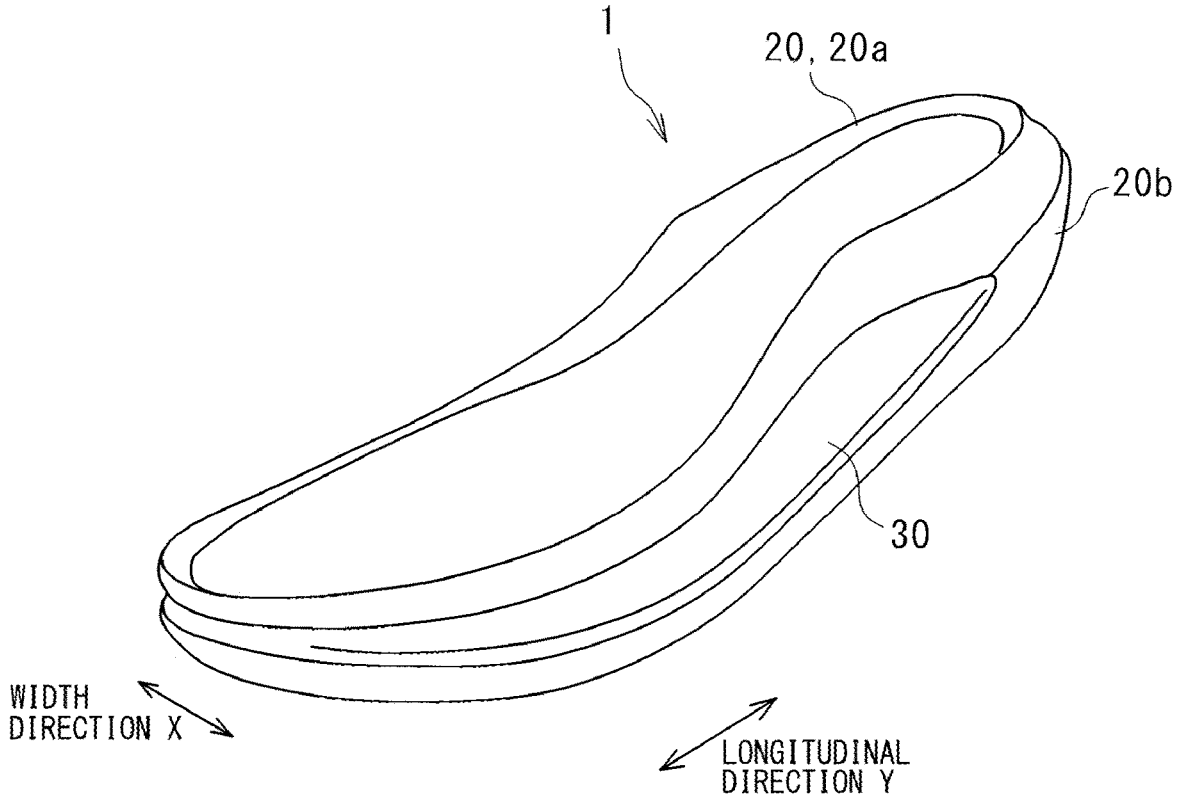
FIG. 11 is a perspective view that illustrates an external view of a shoe sole according to a third embodiment.
Figure 12:
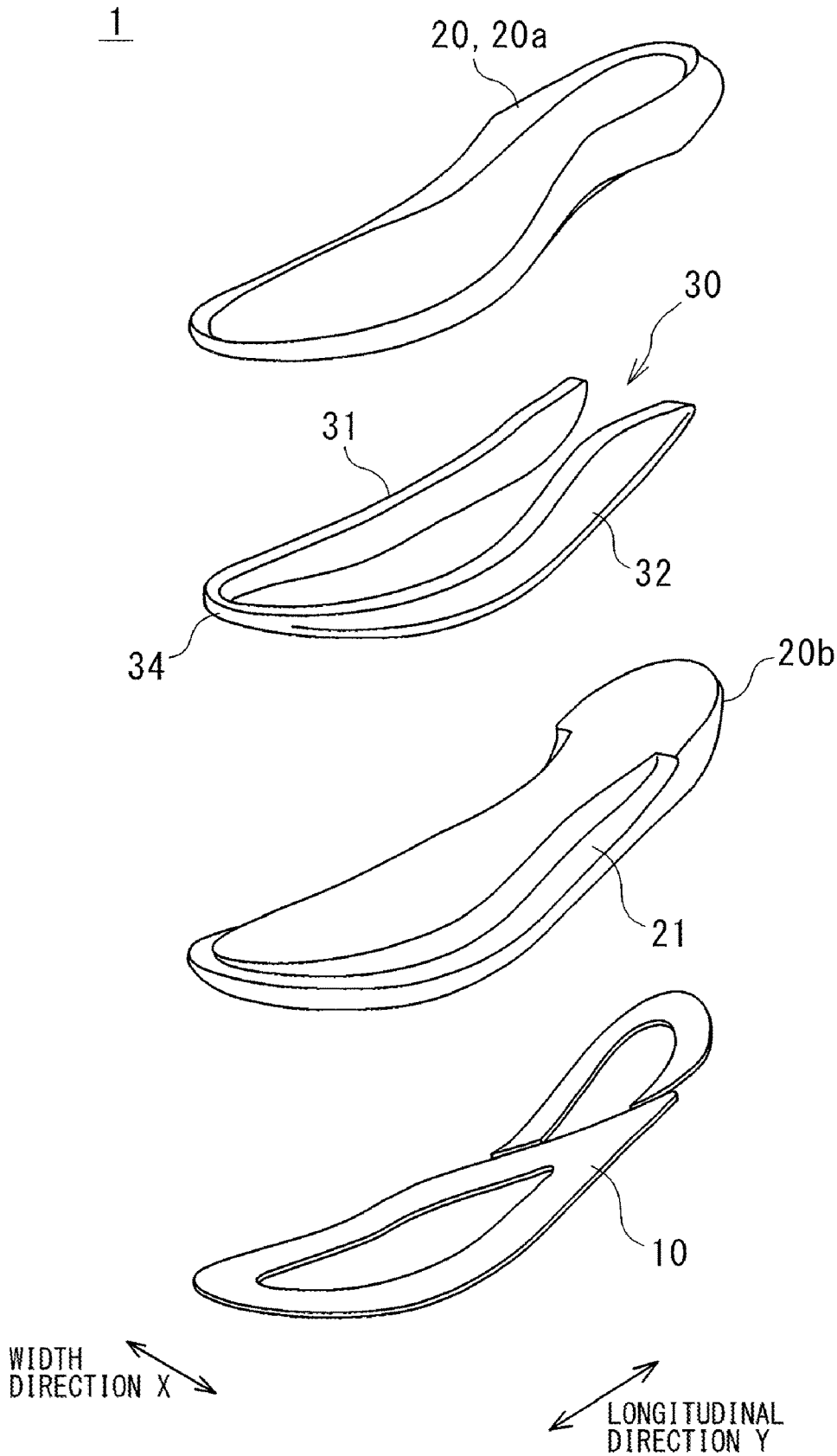
FIG. 12 is an exploded perspective view of the shoe sole.
Figure 13:
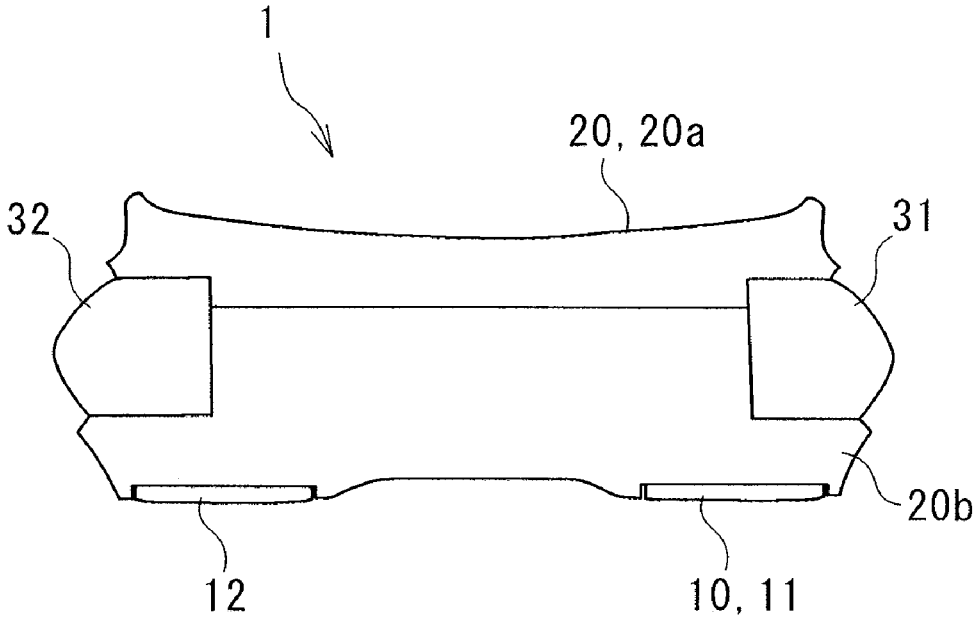
FIG. 13 is a sectional view of the shoe sole at a cross section equivalent to that shown in FIG. 4B.

FIG. 11 is a perspective view that illustrates an external view of the shoe sole 1 according to the third embodiment, and FIG. 12 is an exploded perspective view of the shoe sole 1. FIG. 13 is a sectional view of the shoe sole 1 at a cross section equivalent to that shown in FIG. 4B. As is the case in the first and second embodiments, the shoe sole 1 according to the third embodiment also includes the outer sole 10, the bottom part 20, and the deformation restraining part 30; however, the bottom part 20 is divided into an upper bottom part 20*a* and a lower bottom part 20*b*. Also, the deformation restraining part 30 includes a connection part 34 that connects the medial deformation restraining part 31 and the lateral deformation restraining part 32 on the toe side.

In the bottom part 20, a recess 21 is formed on the medial side, the lateral side, and the toe part of the lower bottom part 20*b*, and the deformation restraining part 30 is fitted into the recess 21. The deformation restraining part 30 is bonded such as to be sandwiched between the upper bottom part 20*a* and the lower bottom part 20*b*. Also, the lower surface of the upper bottom part 20*a* is bonded to the upper surface of the lower bottom part 20*b*. Although the upper bottom part 20*a* and the lower bottom part 20*b* may be formed by integral molding, if the shape of the recess 21 into which the deformation restraining part 30 is fitted is made complex thereby, the manufacturability can be improved by separately forming the upper bottom part 20*a* and the lower bottom part 20*b*, as shown in FIG. 12.

Also, the medial deformation restraining part 31 and the lateral deformation restraining part 32 of the deformation restraining part 30 are connected by the connection part 34 on the toe side, which facilitates the handling of the shoe sole 1 at the time of assembly and hence facilitates the assembly.

As illustrated in FIG. 13, the deformation restraining part 30 is positioned closer to the vertically upper side of the lower bottom part 20*b*, and the lower surface side of the deformation restraining part 30 is covered with the lower bottom part 20*b*. Accordingly, the deformation restraining part 30 is not exposed to the lower surface side of the shoe sole 1, so that the peeling off of the bonded part of the deformation restraining part 30 can be prevented. Also, when viewed along a vertical direction, the deformation restraining part 30 is disposed around the middle of the bottom part 20 including the upper bottom part 20*a* and the lower bottom part 20*b*; however, by reducing the thickness of the upper bottom part 20*a*, the positional relationship can be made such that the deformation restraining part 30 is disposed closer to the vertically upper side of the bottom part 20.

As is the case in the first embodiment, the shoe sole 1 is formed such that the toe side is positioned higher than the heel side. Accordingly, when the wearer of the shoe 100 walks or runs, energy consumption at the ankle joint can be reduced, thereby enabling walking and running with less effort.

There will now be described the features of the shoe sole 1 and the shoe 100 according to the embodiments and the modifications.

The shoe sole 1 includes the bottom part 20 and the deformation restraining part 30. The bottom part 20 includes: the rear bottom surface part 24 formed to extend from the rearfoot portion to the midfoot portion and to be, when the shoe sole is placed on the virtual surface S as a flat surface, in contact with the virtual surface S; and the toe portion 26 of which the height from the virtual surface S is set to 100% or greater and 250% or less with respect to the thickness dimension in the rear bottom surface part 24. The deformation restraining part 30 is disposed in an edge part on the medial side and the lateral side of the bottom part 20 and extends from the forefoot portion to the midfoot portion along the bottom part 20. Also, the deformation restraining part 30 has higher hardness than the bottom part 20. Accordingly, the shoe sole 1 can ensure stability of landing of the rear bottom surface part 24 and also reducing the strain at the ankle joint during forward walking and running.

The shoe sole 1 includes the bottom part 20 and the deformation restraining part 30. The bottom part 20 includes: the rear bottom surface part 24 formed to extend from the rearfoot portion to the midfoot portion and to be, when the shoe sole is placed on the virtual surface S as a flat surface, in contact with the virtual surface S; and the front bottom surface part 25 formed to continue to a front part of the rear bottom surface part 24 and also curvedly extend to the toe portion 26 such as to be spaced away from the virtual surface S. The deformation restraining part 30 is disposed in an edge part on the medial side and the lateral side of the bottom part 20 and extends from the forefoot portion to the midfoot portion along the bottom part 20. Also, the deformation restraining part 30 has higher rigidity than the bottom part 20. The rigidity against the bending deformation in a vertical direction of the whole shoe sole 1 is in the range from 20 N/mm to 50 N/mm inclusive. Accordingly, the shoe sole 1 can ensure stability of landing of the rear bottom surface part 24 and also reduce the strain at the ankle joint during forward walking and running. The rigidity against the bending deformation of the deformation restraining part 30 may preferably be in the range from 1.5 times to 4 times, inclusive, the rigidity against the bending deformation of other regions, such as a center part of the shoe sole 1 sandwiched between the medial deformation restraining part 31 and the lateral deformation restraining part 32. If the rigidity against the bending deformation of the deformation restraining part 30 is low, the shoe sole 1 will be easily deformed. However, if the rigidity against the bending deformation of the deformation restraining part 30 is excessively high, a large shear force may be applied to the boundary regions with other portions, and hence, the shape or the like needs to be devised.

The shoe sole 1 includes the bottom part 20 and the deformation restraining part 30. The bottom part 20 includes the bottom surface part 60 that includes the rear bottom surface part 24 formed to extend from the rearfoot portion to the midfoot portion and to be, when the shoe sole is placed on the virtual surface S as a flat surface, in contact with the virtual surface S and that also includes the front bottom surface part 25 formed to continue to a front part of the rear bottom surface part 24 and also curvedly extend to the toe portion 26 such as to be spaced away from the virtual surface S. The deformation restraining part 30 is disposed in an edge part on a medial side and a lateral side of the bottom part 20 and extends from a forefoot portion to the midfoot portion along the bottom part 20. Also, the deformation restraining part 30 has higher hardness than the bottom part 20. The bottom part 20 further includes the upper surface part 61 that includes the first upper surface part 27 constituted by a surface formed to extend from the rearfoot portion to the midfoot portion and formed to be parallel with the virtual surface S or to extend downward from a rear part toward a front side in an unloading state and that also includes the second upper surface part 28 constituted by a surface formed to continue to a front end of the first upper surface part 27 and extend upward toward the front side to reach the toe portion 26. A region facing an MP joint part of a foot is provided in the front bottom surface part 25 in the bottom surface part 60 and in the second upper surface part 28 in the upper surface part 61. Accordingly, in the shoe sole 1, since the downward inclination of the first upper surface part 27 toward the front side is maintained within a certain range, the upward inclination of the second upper surface part 28 toward the front side can be made gentle, so that excessive upward bending of the toe can be prevented.

The deformation restraining part 30 may be formed outside a region where a foot is in contact with the bottom part 20. Accordingly, in the shoe sole 1, the feeling of hardness on the medial side and the lateral side of the foot can be prevented.

In the deformation restraining part 30, the medial side and the lateral side may be connected on the toe side. This facilitates the handling of the shoe sole 1 at the time of assembly and hence facilitates the assembly.

In the deformation restraining part 30, the medial side may extend longer to the rearfoot portion than the lateral side. Accordingly, in the shoe sole 1, the deformation on the medial side is restrained, and the restraint on the bending deformation in a vertical direction on the lateral side is eased.

The deformation restraining part 30 may be disposed closer to a vertically upper side of the bottom part 20. Also, the bottom part 20 may be formed to cover a lower surface side of the deformation restraining part 30. Accordingly, in the shoe sole 1, the bonded part between the deformation restraining part 30 and the bottom part 20 is not exposed to the lower surface side, so that the durability can be improved.

The deformation restraining part 30 may be disposed closer to a vertically lower side of the bottom part 20, and the outer sole 10 may be formed to cover a lower surface side of the deformation restraining part 30 and the bottom part 20. Accordingly, in the shoe sole 1, the bonded part between the deformation restraining part 30 and the bottom part 20 is protected by the outer sole 10, so that the durability can be improved.

Also, an inner side surface of the deformation restraining part 30 intersecting a lateral direction of a foot may be inclined such as to extend inward in the lateral direction toward the lower side. Accordingly, in the shoe sole 1, the feeling of hardness at a portion with which the foot comes into contact can be reduced.

Also, at least one of the bottom part 20 or the deformation restraining part 30 may be formed of a foam material. This can reduce the weight of the constituting members of the shoe sole 1.

The shoe 100 includes any one of the shoe soles 1 described above, and the upper 9 disposed on the shoe sole 1. Accordingly, the shoe 100 can ensure stability of landing of the rear bottom surface part 24 and also reduce the strain at the ankle joint during forward walking and running.

The present invention has been described with reference to embodiments. The embodiments are intended to be illustrative only, and it will be obvious to those skilled in the art that various modifications and changes could be developed within the scope of claims of the present invention and that such modifications and changes also fall within the scope of claims of the present invention. Therefore, the description in the present specification and the drawings should be regarded as exemplary rather than limitative.

INDUSTRIAL APPLICABILITY

The present invention relates to a shoe sole and a shoe.

REFERENCE SIGNS LIST

1 shoe sole
20 bottom part
30 deformation restraining part
24 rear bottom surface part
25 front bottom surface part
26 toe portion
27 first upper surface part
28 second upper surface part
60 bottom surface part
61 upper surface part
9 upper
100 shoe

The invention claimed is:

1. A shoe sole, comprising:

a bottom part that includes a rear bottom surface part formed to extend from a rearfoot portion to a midfoot portion and to be, when the shoe sole is placed on a virtual surface as a flat surface, in contact with the virtual surface and that also includes a toe portion of which a height from the virtual surface is set to 100% or greater and 250% or less with respect to a thickness dimension in the rear bottom surface part; and a deformation restraining part that is disposed in an edge part on a medial side and a lateral side of the bottom part and extends from a forefoot portion and terminates at a position between a rear end of the midfoot portion and a middle of the rearfoot portion in a longitudinal direction along the medial side and the lateral side of the bottom part and that has higher hardness than the bottom part.

2. The shoe sole according to claim 1, wherein the deformation restraining part is formed to extend beyond an outer periphery of an outer sole in a lateral direction.

3. The shoe sole according to claim 1, wherein, in the deformation restraining part, the medial side and the lateral side are connected on the toe side.

4. The shoe sole according to claim 1, wherein, in the deformation restraining part, the medial side extends longer to the rearfoot portion than the lateral side.

5. The shoe sole according to claim 1, wherein the deformation restraining part is disposed closer to a vertically upper side of the bottom part, and the bottom part is formed to cover a lower surface side of the deformation restraining part.

6. The shoe sole according to claim 1, wherein the deformation restraining part is disposed closer to a vertically lower side of the bottom part, and an outer sole is formed to cover a lower surface side of the deformation restraining part and the bottom part.

7. The shoe sole according to claim 1, wherein in a sectional view of the shoe sole along a lateral direction of the shoe sole, an inner side surface of the deformation restraining part is inclined to extend inward in the lateral direction and toward the lower side.

8. The shoe sole according to claim 1, wherein at least one of the bottom part or the deformation restraining part is formed of a foam material.

9. A shoe, comprising:

the shoe sole according to claim 1; and an upper disposed on the shoe sole.

10. The shoe sole according to claim 1, wherein the deformation restraining part includes a medial deformation restraining part provided on the medial side; and a lateral deformation restraining part provided on the lateral side, and the medial deformation restraining part and the lateral restraining part extend in the same range in a longitudinal direction of the shoe sole.

11. The shoe sole according to claim 1, wherein the deformation restraining part includes a medial deformation restraining part provided on the medial side; a lateral deformation restraining part provided on the lateral side; and a connection part that connects a position around a middle of the medial deformation restraining part in a longitudinal direction of the shoe sole and a position around a rear end of the lateral deformation restraining part.

12. A shoe sole, comprising:

a bottom part that includes a rear bottom surface part formed to extend from a rearfoot portion to a midfoot portion and to be, when the shoe sole is placed on a virtual surface as a flat surface, in contact with the virtual surface and that also includes a front bottom surface part formed to continue to a front part of the rear bottom surface part and also curvedly extend to a toe portion such as to be spaced away from the virtual surface; and a deformation restraining part that is disposed in an edge part on a medial side and a lateral side of the bottom part and extends from a forefoot portion and terminates at a position between a rear end of the midfoot portion and a middle of the rearfoot portion in a longitudinal direction along the medial side and the lateral side of the bottom part and that has higher rigidity than the bottom part, wherein the rigidity against bending deformation in a vertical direction of the shoe sole is in the range from 20 N/mm to 50 N/mm inclusive.

13. The shoe sole according to claim 12, wherein the deformation restraining part includes a medial deformation restraining part provided on the medial side; and a lateral deformation restraining part provided on the lateral side, and the medial deformation restraining part and the lateral restraining part extend in the same range in a longitudinal direction of the shoe sole.

14. The shoe sole according to claim 12, wherein the deformation restraining part includes a medial deformation restraining part provided on the medial side; a lateral deformation restraining part provided on the lateral side; and a connection part that connects a position around a middle of the medial deformation restraining part in a longitudinal direction of the shoe sole and a position around a rear end of the lateral deformation restraining part.

15. A shoe sole, comprising:

a bottom part comprising a bottom surface part that includes a rear bottom surface part formed to extend from a rearfoot portion to a midfoot portion and to be, when the shoe sole is placed on a virtual surface as a flat surface, in contact with the virtual surface and that also includes a front bottom surface part formed to continue to a front part of the rear bottom surface part and also curvedly extend to a toe portion such as to be spaced away from the virtual surface; and a deformation restraining part that is disposed in an edge part on a medial side and a lateral side of the bottom part and extends from a forefoot portion and terminates at a position between a rear end of the midfoot portion and a middle of the rearfoot portion in a longitudinal direction along the medial side and the lateral side of the bottom part and that has higher hardness than the bottom part, wherein the bottom part further comprises an upper surface part that includes a first upper surface part constituted by a surface formed to extend from the rearfoot portion to the midfoot portion and formed to be parallel with the virtual surface or to extend downward from a rear part toward a front side in an unloading state and that also includes a second upper surface part constituted by a surface formed to continue to a front end of the first upper surface part and extend upward toward the front side to reach the toe portion, and a region facing an MP joint part of a foot is provided in the front bottom surface part in the bottom surface part and in the second upper surface part in the upper surface part.

16. The shoe sole according to claim 15, wherein the deformation restraining part includes a medial deformation restraining part provided on the medial side; and a lateral deformation restraining part provided on the lateral side, and the medial deformation restraining part and the lateral restraining part extend in the same range in a longitudinal direction of the shoe sole.

17. The shoe sole according to claim 15, wherein the deformation restraining part includes a medial deformation restraining part provided on the medial side; a lateral deformation restraining part provided on the lateral side; and a connection part that connects a position around a middle of the medial deformation restraining part in a longitudinal direction of the shoe sole and a position around a rear end of the lateral deformation restraining part.

* * * * *